US012521595B2

(12) United States Patent
Byun

(10) Patent No.: US 12,521,595 B2
(45) Date of Patent: Jan. 13, 2026

(54) HIGH-LOW MACHINE

(71) Applicant: Newtech wellness Corporation, Gimhae-si (KR)

(72) Inventor: Hyun Jung Byun, Busan (KR)

(73) Assignee: Newtech wellness Corporation, Gimhae-si (KR)

( * ) Notice: Subject to any disclaimer, the term of this patent is extended or adjusted under 35 U.S.C. 154(b) by 157 days.

(21) Appl. No.: 18/515,258

(22) Filed: Nov. 21, 2023

(65) Prior Publication Data

US 2025/0073521 A1 Mar. 6, 2025

(30) Foreign Application Priority Data

Aug. 30, 2023 (KR) ..... 10-2023-0114711

(51) Int. Cl.
*A63B 21/06* (2006.01)
*A63B 21/00* (2006.01)

(52) U.S. Cl.
CPC ..... *A63B 21/0615* (2013.01); *A63B 21/4035* (2015.10); *A63B 2208/0233* (2013.01)

(58) Field of Classification Search
CPC ..... A63B 21/00058; A63B 21/00061; A63B 21/00065; A63B 21/06; A63B 21/0615; A63B 21/08; A63B 21/159; A63B 21/4029; A63B 21/4035; A63B 21/4047; A63B 23/03525; A63B 23/12; A63B 23/1218; A63B 2208/0233; A63B 2225/09; A63B 2225/093; A63B 2244/09
See application file for complete search history.

(56) References Cited

U.S. PATENT DOCUMENTS 4,623,144 A * 11/1986 Rockwell ..... A63B 23/0211 482/137
4,951,939 A * 8/1990 Peters ..... A63B 21/0615 482/94
5,050,873 A * 9/1991 Jones ..... A63B 21/4047 482/138
5,273,504 A * 12/1993 Jones ..... A63B 23/1263 482/133
5,273,505 A * 12/1993 Jones ..... A63B 21/0615 482/133
2002/0035017 A1* 3/2002 Pertegaz-Esteban ..... A63B 23/03533 482/92
2002/0052268 A1* 5/2002 Morcillo-Quintero ..... A63B 23/1263 482/92

(Continued)

FOREIGN PATENT DOCUMENTS

DE 202022102400 U1 * 5/2022 ..... A63B 21/4047
EP 4070862 A1 * 10/2022 ..... A63B 23/1209
KR 10-1524970 B1 6/2015

*Primary Examiner* — Gary D Urbiel Goldner
(74) *Attorney, Agent, or Firm* — Revolution IP, PLLC

(57) ABSTRACT

A high-low machine includes a support frame (110) mounted on a floor; a main body frame (120) connected to the support frame (110); a weight part (130) mounted to be able to rotate at one point on the main body frame (120) and on which a weight plate (131) is mounted; a rotating part (140) rotatably mounted at another point of the main body frame (120); a connecting part (150) provided to connect the weight part (130) and the rotating part (140); and a grip part (160) connected to one end of the rotating part (140) and providing a space for a user to grip.

5 Claims, 9 Drawing Sheets

(56) References Cited

U.S. PATENT DOCUMENTS

| | | | | |
|---|---|---|---|---|
| 2002/0187882 | A1* | 12/2002 | Morris | A63B 21/4035 482/92 |
| 2005/0148445 | A1* | 7/2005 | Carle | A63B 21/08 482/99 |
| 2007/0293377 | A1* | 12/2007 | Webber | A63B 23/03525 482/94 |
| 2019/0282851 | A1* | 9/2019 | Hockridge | A63B 21/4035 |
| 2023/0249029 | A1* | 8/2023 | Byun | A63B 21/078 482/97 |

* cited by examiner

【FIG. 1】
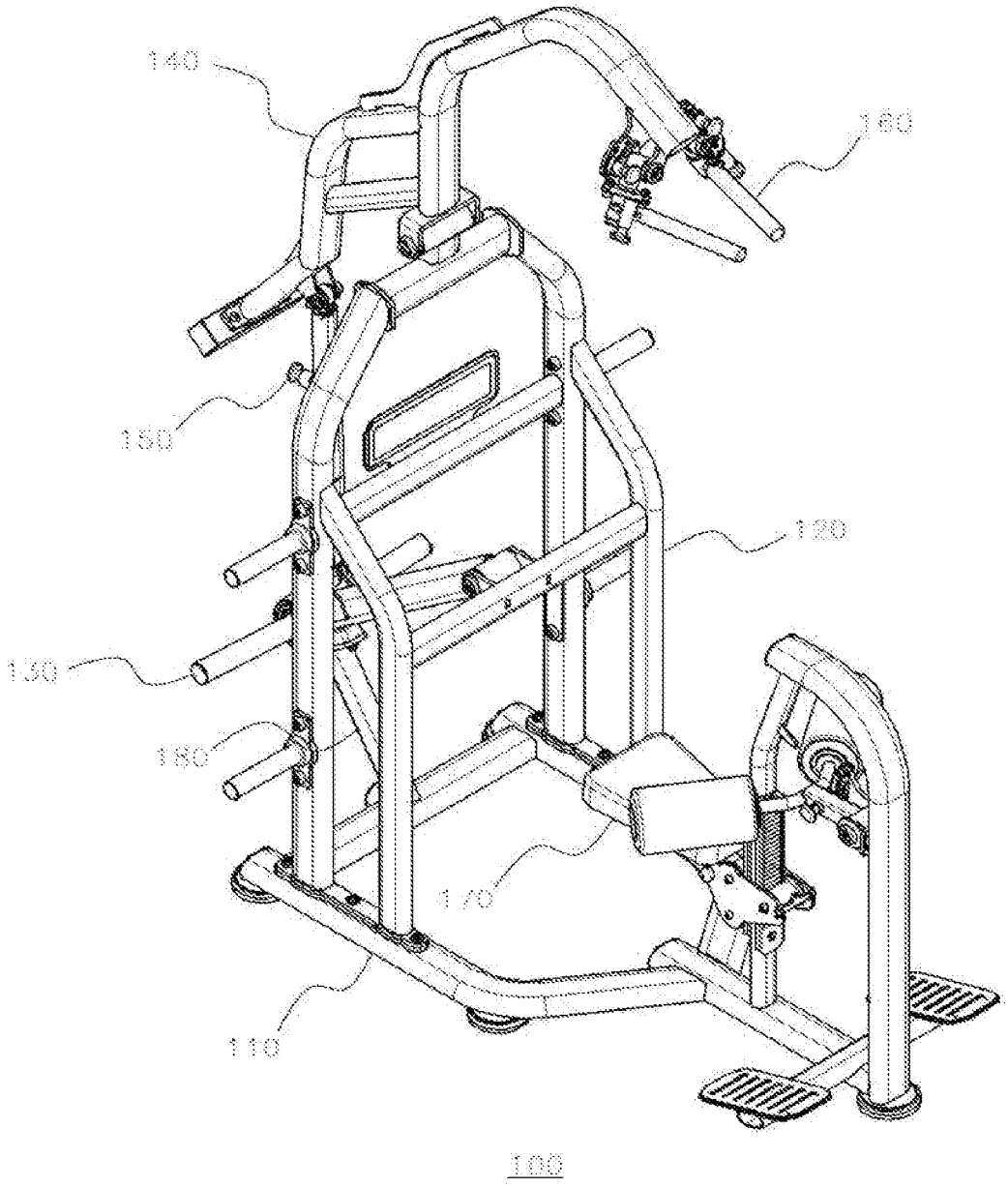

【FIG. 2】
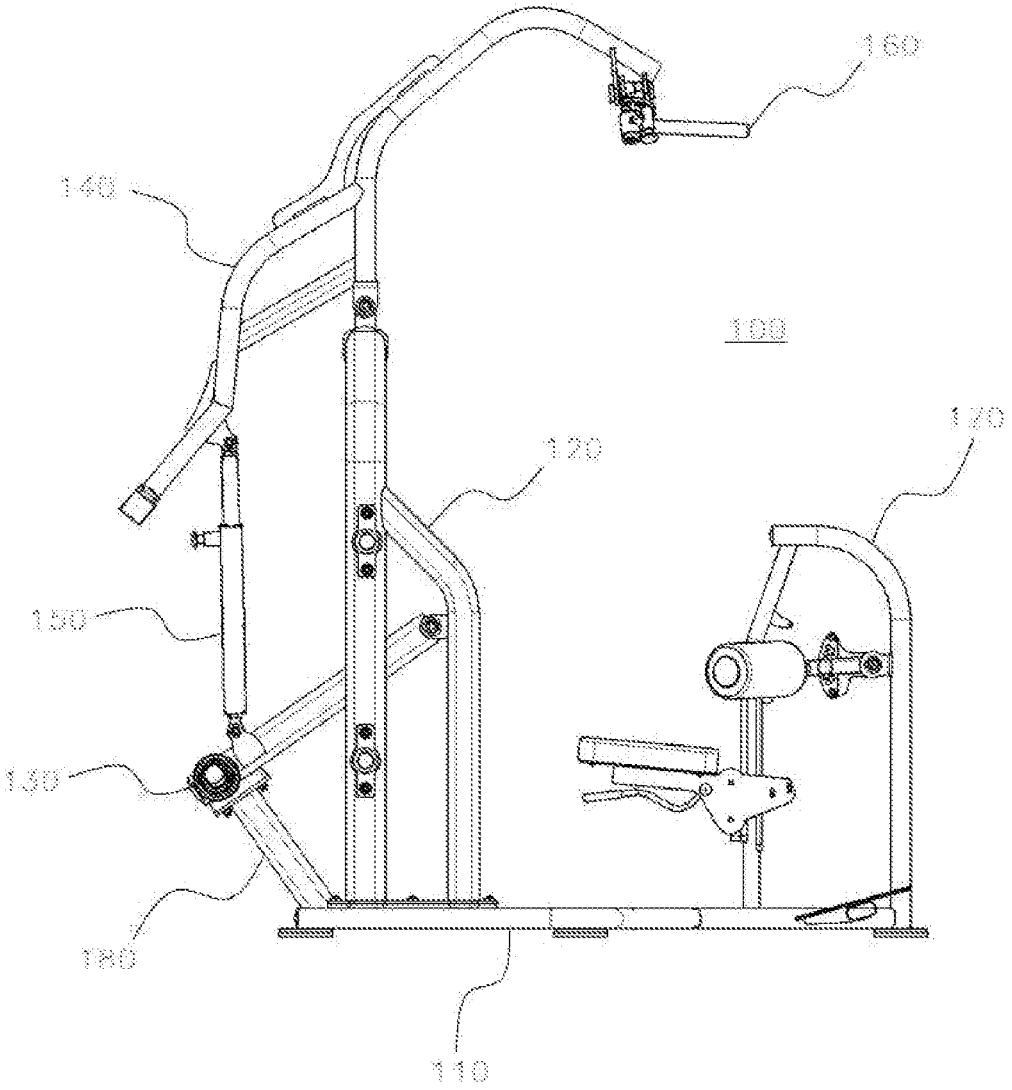

【FIG. 3】
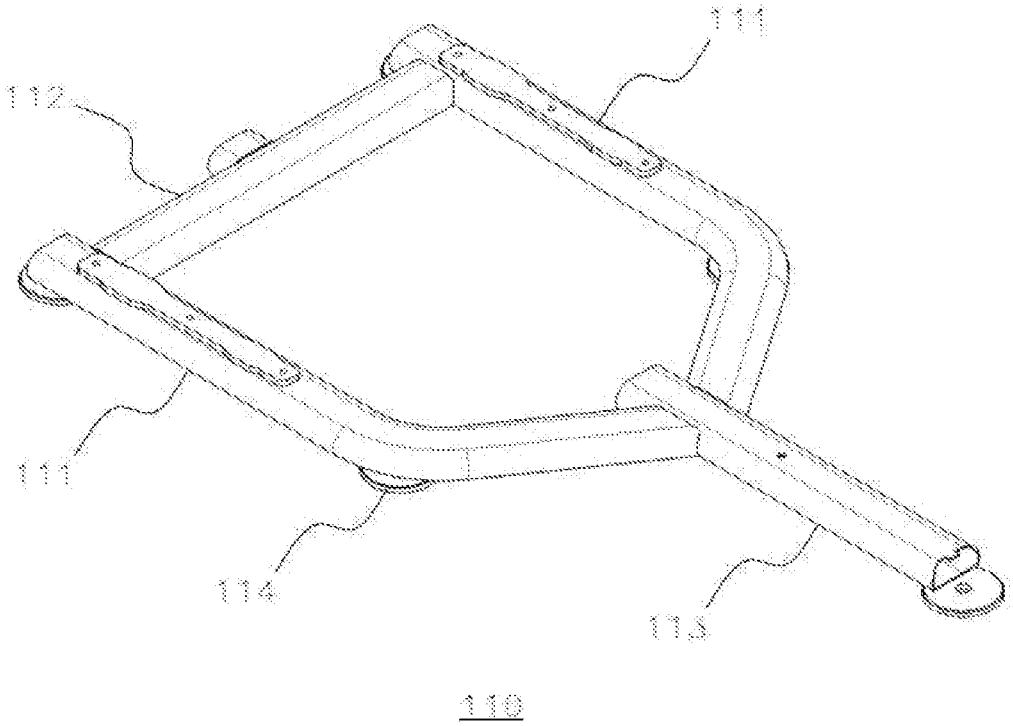

【FIG. 4】
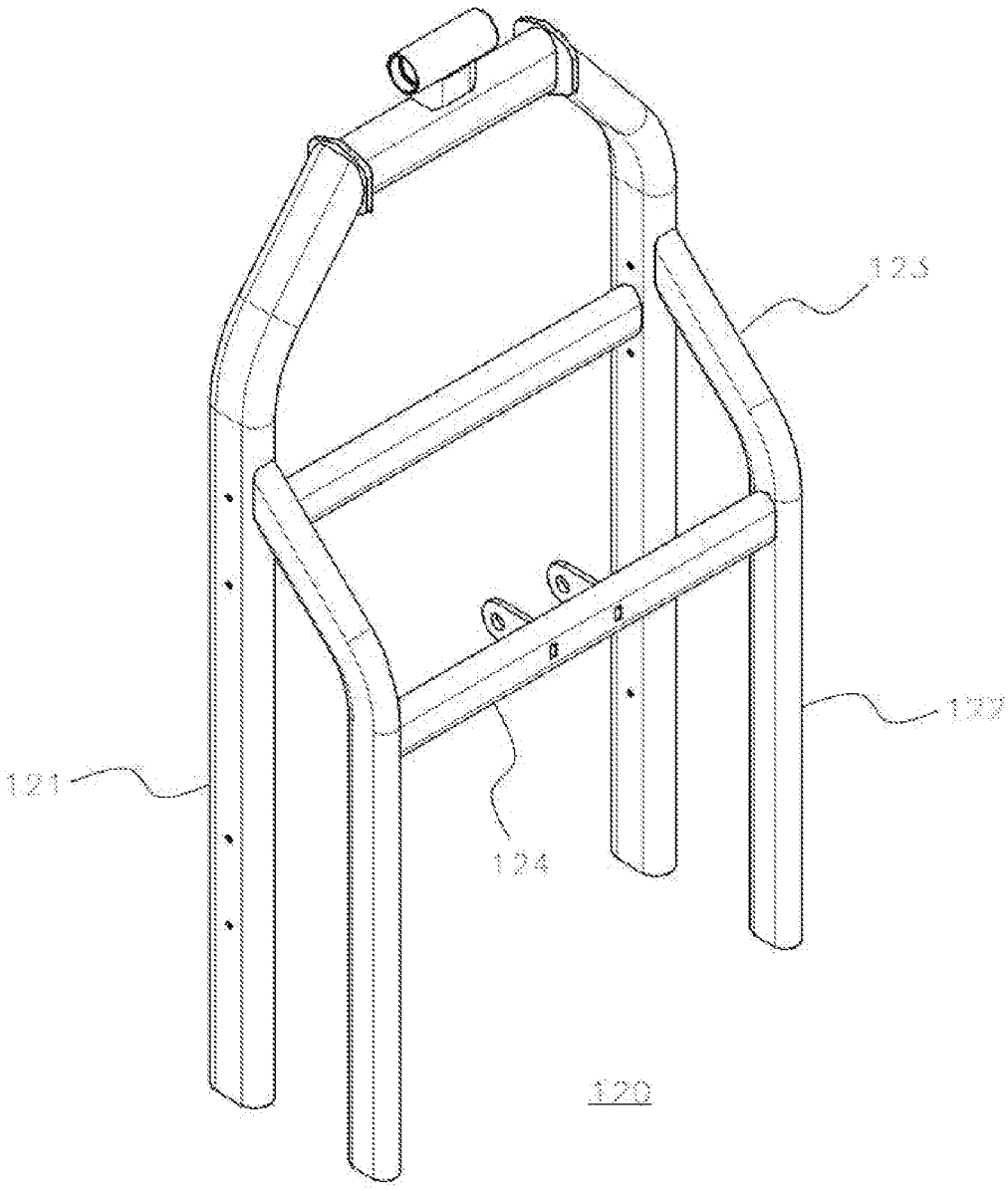

【FIG. 5】
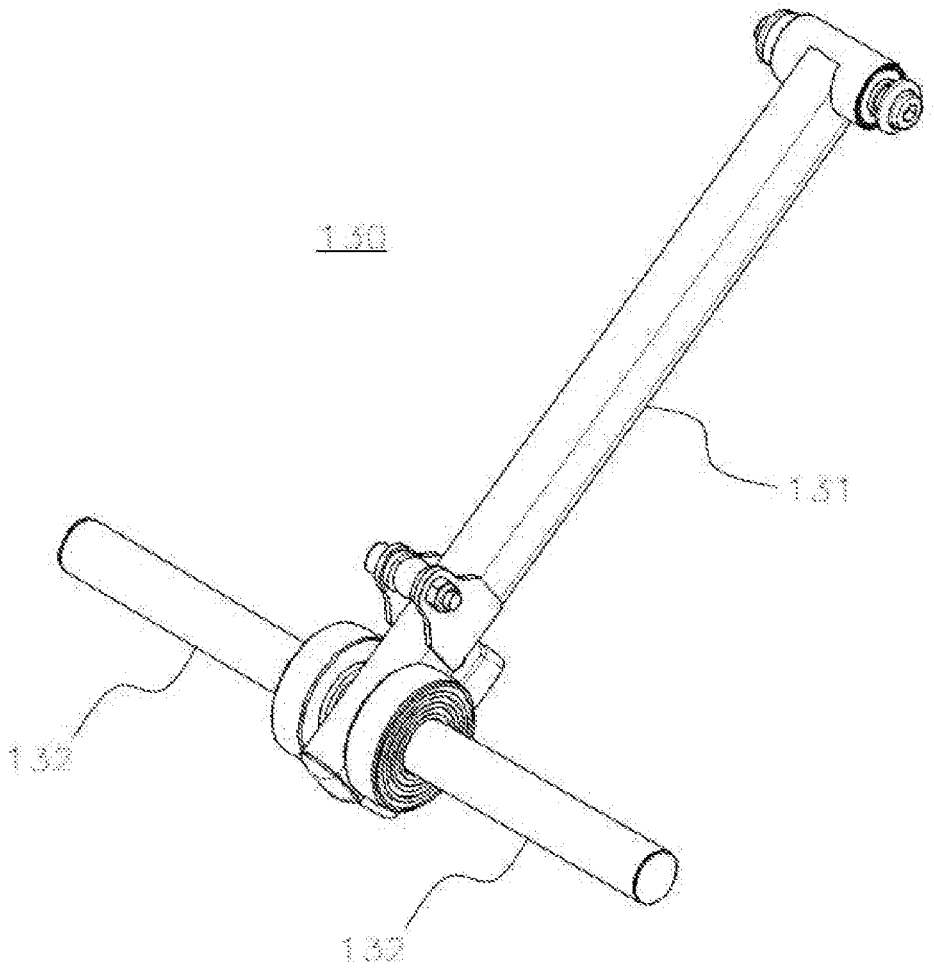

【FIG. 6】
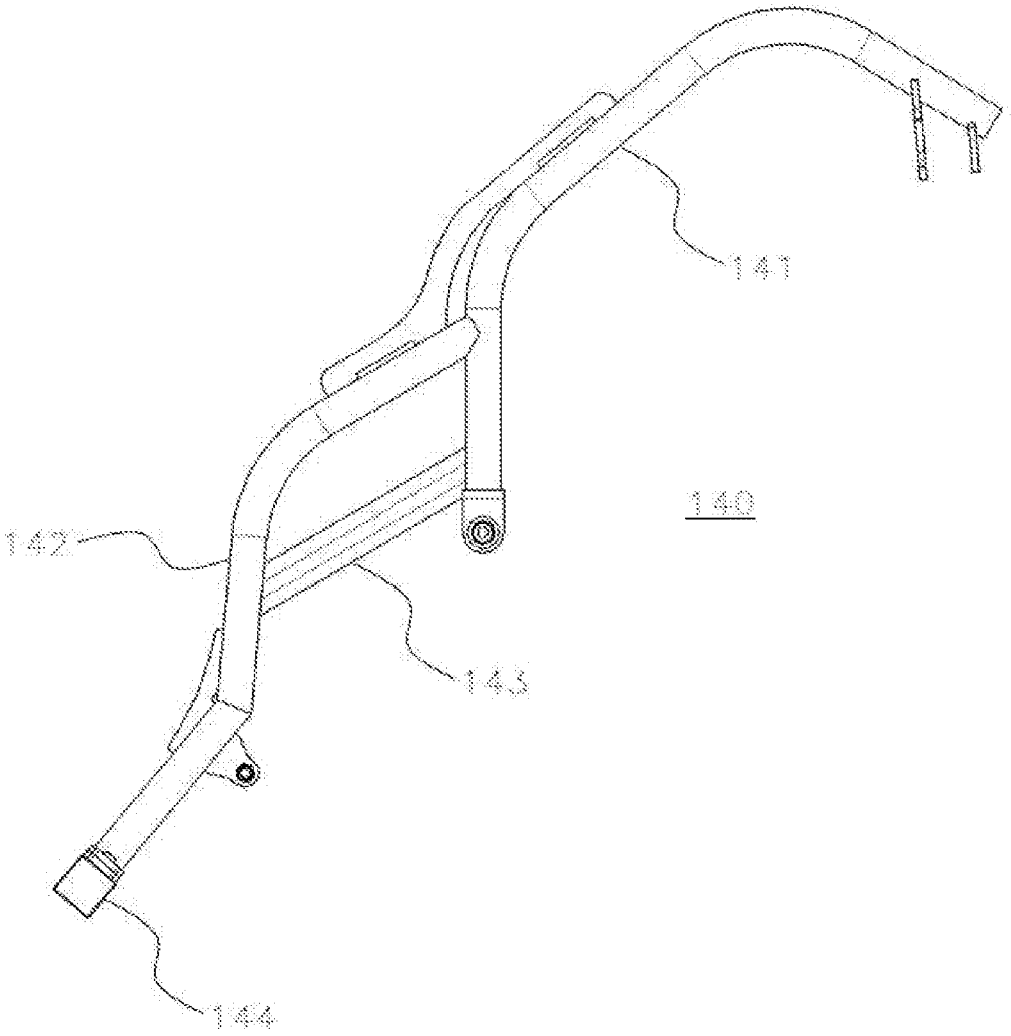

【FIG. 7】
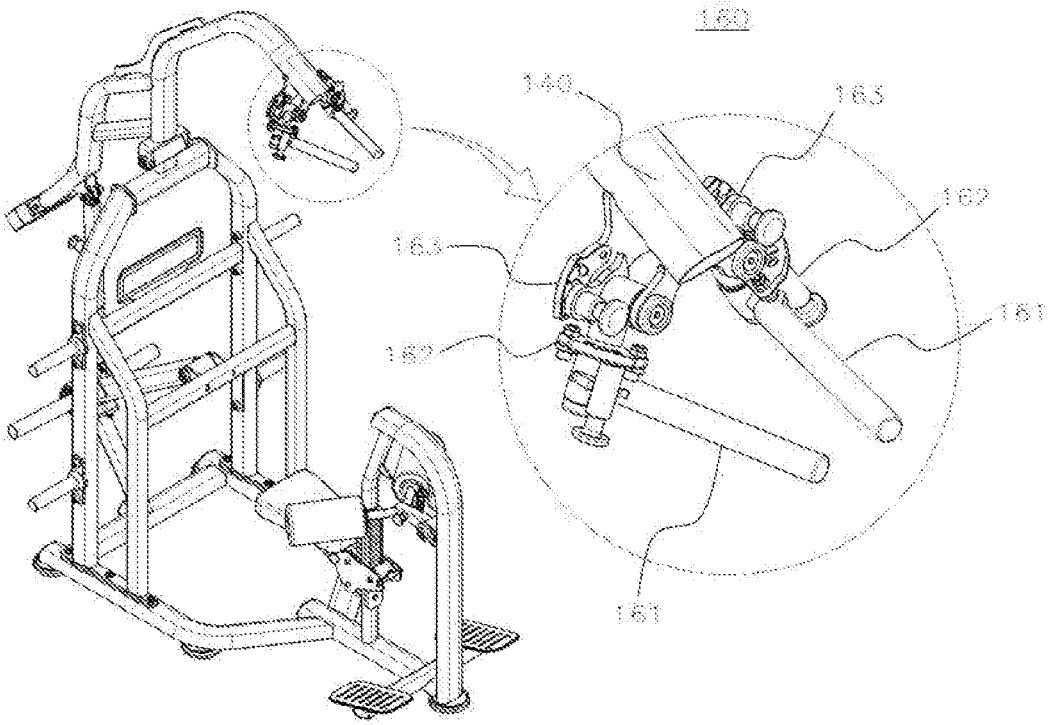

【FIG. 8】
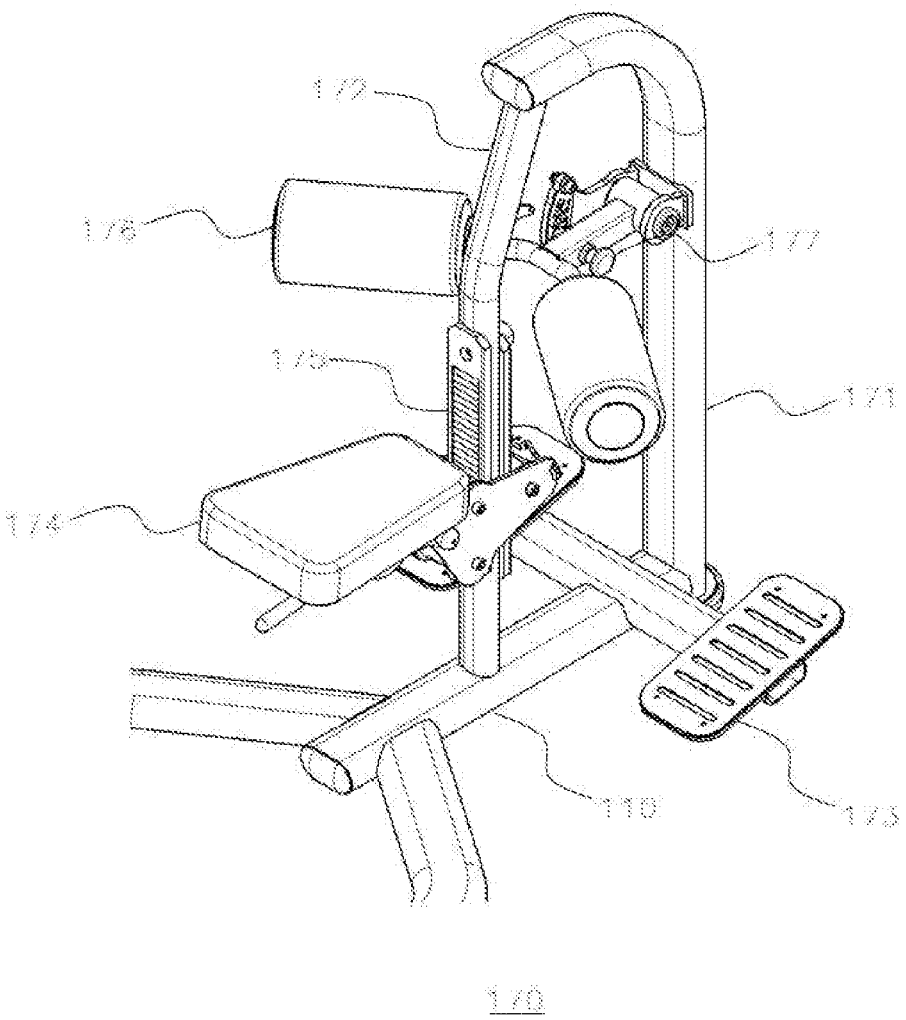

【FIG. 9】
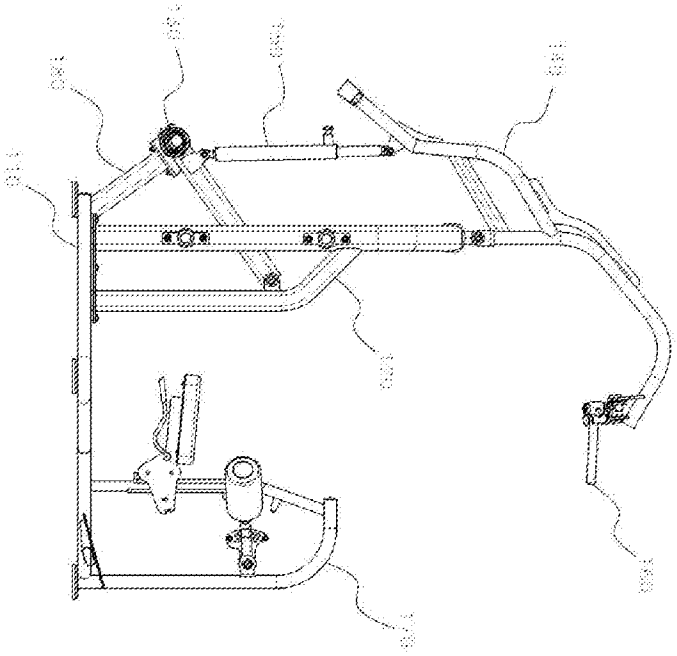
(a)
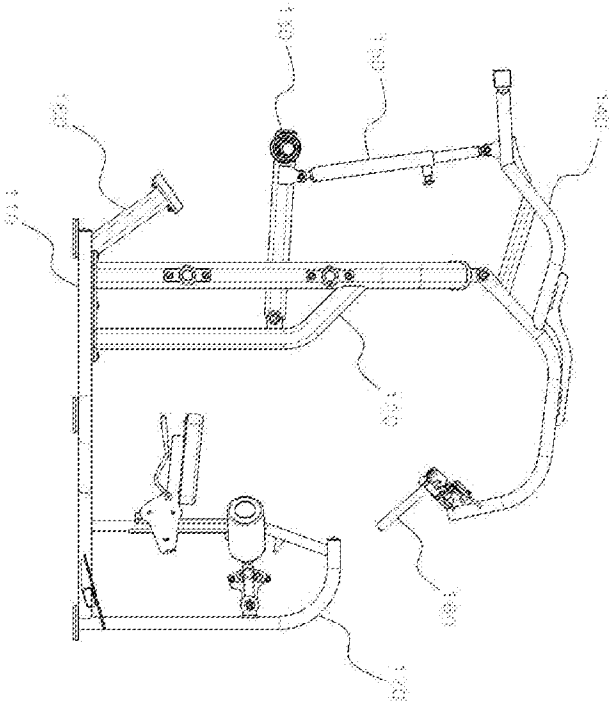
(b)

HIGH-LOW MACHINE

FIELD OF THE INVENTION

The present invention relates to a high-low machine: more specifically, it is about a high-low machine that allows the user to exercise intensely by adjusting the handle angle according to the user's needs to various angles and selecting the grip by providing a first angle adjuster and a second angle adjuster based on the two axes orthogonal to the grip section.

BACKGROUND ART

Recently, as the public's interest in fitness has increased, it has become very easy to learn the knowledge related to fitness due to the development of media related to exercise postures.

However, because exercise equipment is relatively expensive, most people pay a fee to use the equipment at the gym. However, because gyms are crowded at certain times or on public holidays, people often have to wait to use the exercise equipment they want to use. Due to this issue, the need for exercise equipment that allows multiple people to do many types of exercise without requiring a large space has increased.

Existing high-low machines are used by many people to exercise their lats, but due to the limited grip, people have not been able to intensively exercise more diverse areas.

Therefore, we need research on a high-low machine that allows the user to exercise intensely by adjusting the handle angle according to the user's needs to various angles and selecting the grip by providing a first angle adjuster and a second angle adjuster based on the two axes orthogonal to the grip section.

PRIOR ART LITERATURE

Patent Literature (Patent Literature 1) Korea Registered Patent No. 10-1524970

SUMMARY OF THE INVENTION

Problem the Invention Attempts to Solve

The object of the present invention is to provide a high-low machine that allows the user to exercise intensely by adjusting the handle angle according to the user's needs to various angles and selecting the grip by providing a first angle adjuster and a second angle adjuster based on the two axes orthogonal to the grip section.

In addition, another object of the present invention is to provide a high-low machine that allows exercise to be performed by selecting one arm motion or both arm motion, thereby enabling customized motion performance according to the purpose of exercise.

In addition, another object of the present invention is to provide a high-low machine that can adjust the height of the seat part, the angle of the knee support part, etc., and thus can accommodate various user body sizes.

Solution to Problem

A high-low machine according to an embodiment of the present invention may include a support frame (110) mounted on the floor: a main body frame (120) connected to the support frame (110) to form a support structure: a weight part (130) mounted to be able to rotate at one point on a main body frame (120) and on which the weight plate (131) is mounted: a rotating part (140) rotatably mounted at another point of the main body frame (120); a connecting part (150) provided to connect the weight part (130) and the rotating part (140) to transmit the load of the weight plate (131) to the rotating part (140) and to enable length adjustment: a grip part (160) connected to one end of the rotating part (140) and providing a space for the user to grip; and the above grip part including: a pair of handles (161) provided for the user to grip: a pair of first angle adjusters (162) provided at one end of each of the pair of handles (161) and configured to adjust the angle of the handle (161) with respect to the first axis; and a pair of second angle adjusters (163) provided to connect one end of each of the pair of first angle adjusters (162) to one end of the rotating part (140), and to adjust the angle of the handle (161) based on a second axis orthogonal to the first axis; and when descending due to an external force applied by the user, the descent occurs in an arc motion, and when the external force applied by the user is released, it may return along the descending path by the weight plate (131)'s own weight.

In addition, the main body frame (120) according to an embodiment of the present invention may include a standing frame (121) erected from the support frame (110), a pair of parallel frames (122) arranged in parallel with the standing frame (121), a pair of inclined frames (123) extending from the upper ends of each of the pair of parallel frames (122) and having one end connected to the standing frame (121), and a connecting frame (124) vertically connects the pair of parallel frames (122).

In addition, the rotating part (140) according to an embodiment of the present invention may include a first rotating frame (141) that has two curved parts and is provided in the shape of a 'U' bar with open ends, a bar-shaped second rotation frame (142) having one end coupled to one point of the first rotation frame (141) and having one curved part and one bent part, a reinforcing frame (143) whose both ends are coupled to the other point of the first rotating frame (141) and the first point of the second rotating frame (142), and a weight (144) provided at one end of the second rotating frame (143) to balance the weight of the grip part (160).

In addition, the first rotating frame (141) according to an embodiment of the present invention has the grip part (160) coupled to one end, and the other end is link coupled to the upper end of the standing frame (121) so as to be rotatable, and additionally, one end of the connecting part (150) may be linked to one point of the second rotating frame (142).

In addition, the seating unit (170) according to an embodiment of the present invention may include a first seating frame (171) that stands up from the support frame (110) and has a curved part, a second seating frame (172) connecting the first point of the first seating frame (171) and the support frame (110), a footrest (173) that is seated on the support frame (110) and disposed on the lower side of the first seating frame (171), a seat part (174) disposed on the upper side of the footrest (172), connected to the second seating frame (172), and providing a space for the user to sit, a height adjuster (175) that slides in the height direction along the second seating frame (172) or is fixed to the second seating frame (172) while mediating between the second seating frame (172) and the seat part (174), a knee support unit (176) mounted on the first seating frame (171) placed higher than the seat unit (174), and disposed above the knees of the user seated on the seat unit (174), and a support angle adjuster (177) that adjusts the angle of the knee support unit (176) with respect to the first seating frame (171).

Effects of the Invention

The high-low machine according to an embodiment of the present invention provides the benefit of allowing the user to exercise intensely by adjusting the handle angle according to the user's needs to various angles and selecting the grip by providing a first angle adjuster and a second angle adjuster based on the two axes orthogonal to the grip section.

In addition, the high-low machine according to an embodiment of the present invention provides the benefit of allowing exercise to be performed by selecting one arm motion or both arm motion, thereby enabling customized motion performance according to the purpose of exercise.

In addition, the high-low machine according to an embodiment of the present invention provides the benefit of adjusting the height of the seat part, the angle of the knee support part, etc., and thus can accommodate various user body sizes.

BRIEF DESCRIPTION OF THE DRAWINGS

FIG. 1 is a perspective view showing a high-low machine according to an embodiment of the present invention.

FIG. 2 is a side view showing a high-low machine according to an embodiment of the present invention.

FIG. 3 is a diagram showing a support frame according to an embodiment of the present invention.

FIG. 4 is a diagram showing a main body frame according to an embodiment of the present invention.

FIG. 5 is a diagram showing a weight part according to an embodiment of the present invention.

FIG. 6 is a diagram showing a rotating part according to an embodiment of the present invention.

FIG. 7 is a diagram showing a grip part according to an embodiment of the present invention.

FIG. 8 is a diagram showing a seating unit according to an embodiment of the present invention.

FIG. 9 is a diagram showing the operation of a high-low machine according to an embodiment of the present invention.

DETAILED DESCRIPTION OF THE INVENTION

Hereinafter, embodiments of the present invention will be described in detail with reference to the attached drawings. However, the idea of the present invention is not limited to the presented embodiments of the present invention: Additionally, a person skilled in the art who understands the spirit of the present invention can easily propose other regressive inventions or other embodiments included within the scope of the present invention by adding, changing, or deleting other components within the scope of the same spirit: However, we can say that such addition, changes, or deletion is also included within the scope of the present invention.

Hereinafter, the high-low machine (100) of the present invention will be described in detail with reference to the attached FIGS. 1 to 8.

FIG. 1 is a perspective view showing a high-low machine according to an embodiment of the present invention and FIG. 2 is a side view showing a high-low machine according to an embodiment of the present invention.

Referring to FIGS. 1 and 2, the high-low machine (100) according to an embodiment of the present invention may include a support frame (110), main body frame (120), weight part (130), rotation part (140), connecting part (150), grip part (160), seating unit (170), and mounting part (180).

The support frame (110) may be seated on the floor. The support frame (110) will be examined in more detail with reference to FIG. 3.

FIG. 3 is a diagram showing a support frame according to an embodiment of the present invention.

Referring to FIG. 3, the support frame (110) according to an embodiment of the present invention may include a support bending frame (111), a support connecting frame (112), and a support protrusion frame (113).

The support bending frame (111) has one curved part, and a pair of curved parts may be arranged in a mirror image.

The support connecting frame (112) can vertically connect a pair of support bending frames (111).

The supporting protruding frame (113) may be provided in a bar shape between the pair of supporting bent frames (111).

The support bending frame (111), the support connecting frame (112), and the support protrusion frame (113) may be provided as frames.

The support frame (110) may be formed by connecting a support bending frame (111), a support connecting frame (112), and a support protrusion frame (113) to each other.

In addition, the support frame (110) may further include friction fixing parts (114) at multiple points below the support bending frame (111), the support connecting frame (112), and the support protrusion frame (113).

The friction fixing part (114) can fix the high-low machine (100) so that it does not slip or move due to friction with the floor.

Referring again to FIGS. 1 and 2, the main body frame (120) may be connected to the support frame (110) to form a support structure. The main body frame (120) will be examined in more detail with reference to FIG. 4.

FIG. 4 is a diagram showing a main body frame according to an embodiment of the present invention.

Referring to FIG. 4, the main body frame (120) according to an embodiment of the present invention may include a standing frame (121), a pair of parallel frames (122), a pair of inclined frames (123), and a connecting frame (124).

The standing frame (121) can be erected from the support frame (110).

A pair of parallel frames (122) may be arranged parallel to the standing frame (121).

A pair of inclined frames (123) are provided to extend from the top of each of the pair of parallel frames (122), and one end may be connected to the standing frame (121).

The connecting frame (124) can vertically connect a pair of support bending frames (122).

In addition, as shown in FIG. 1, the main body frame (120) may be provided with a weight plate storage unit (not shown) capable of holding weight plates of various weights at multiple points. The weight plate storage unit may protrude from at least one of the standing frame (121), a pair of parallel frames (122), a pair of inclined frames (123), and the connecting frame (124), so that the central hole (not shown) of the weight plate is inserted and mounted.

Referring again to FIGS. 1 and 2, the weight part (130) may be rotatably mounted at one point of the main body frame (120), and a weight plate (131) may be mounted thereon. The weight part (130) will be examined in more detail with reference to FIG. 5.

FIG. 5 is a diagram showing a weight part according to an embodiment of the present invention.

Referring to FIG. 5, the weight part (130) according to an embodiment of the present invention may include a weight frame (131) and a pair of weight plate storage bars (132).

One end of the weight frame (131) may be rotatably linked to the connecting frame (124).

A pair of weight plate storage bars (132) are provided to protrude in a bar shape on both sides of the other end of the weight frame (131), and are arranged in a mirror image with respect to the pair of weight frames (131), and the weight plate (131) can be mounted.

Referring again to FIGS. 1 and 2, the weight part (140) may be rotatably mounted at another point of the main body frame (120). The rotating part (140) may be provided by combining oval cylindrical pipes. The rotating part (140) will be examined in more detail with reference to FIG. 6.

FIG. 6 is a diagram showing a rotating part according to an embodiment of the present invention.

Referring to FIG. 6, the rotating unit (140) according to an embodiment of the present invention may include a first rotating frame (141), a second rotating frame (142), a reinforcing frame (143), and a weight (144).

The first rotating frame (141) may be provided in a 'U' bar shape with two curved parts and open ends.

The second rotating frame (142) has one end coupled to one point of the first rotating frame (141) and may be provided in a bar shape having one curved part and one bent part.

The reinforcing frame (143) may be coupled at both ends to the other point of the first rotating frame (141) and the first point of the second rotating frame (142).

A weight (144) is provided at one end of the second rotating frame (143) to balance the weight with the grip part (160). The weight (144) balances the weight of the grip unit (160), thereby preventing an accident that occurs when the grip unit (160) falls due to the load.

Referring again to FIGS. 1 and 2, the connecting part (150) may be provided to connect the weight part (130) and the rotating part (140) to transmit the load of the weight plate (131) to the rotating part (140) and allow length adjustment. The connecting part (150) is provided so that the length can be adjusted, thereby controlling the distance from the weight plate, which has the effect of allowing the user to exercise by adjusting the weight in various ways even with a weight plate of the same weight.

The grip part (160) is connected to one end of the rotating part (140) and can provide a space for the user to grip. Here, a space for the user to grip means providing a member that the user can grab with his/her hand. The grip part (160) will be examined in more detail with reference to FIG. 7.

FIG. 7 is a diagram showing a grip part according to an embodiment of the present invention.

Referring to FIG. 7, the grip part (160) according to an embodiment of the present invention may include a pair of handles (161), a pair of first angle adjusters (162), and a pair of second angle adjusting units (163).

A pair of handles (161) may be provided for a user to grab on.

A pair of first angle adjusters (162) may be provided at one end of each of the pair of handles (161) and may be provided to adjust the angle of the handle (161) with respect to the first axis.

A pair of second angle adjusting units (163) may be provided to connect one end of each of the pair of first angle adjusting units (162) and one end of the rotating unit (140) and adjust the angle of the handle (161) based on a second axis orthogonal to the first axis.

When the grip part (160) descends due to an external force applied by the user, it descends in an arc motion, and when the external force applied by the user is released, it can return along the path descended by the weight of the weight plate (131). The grip part (160) allows the user to exercise intensely by adjusting the handle (161) angle according to the user's needs to various angles and selecting the grip by providing a first angle adjuster (162) and a second angle adjuster (163) based on the two axes orthogonal to the grip section.

Referring again to FIGS. 1 and 2, the seating unit (170) is connected to the support frame (110) and is placed in front of the main body frame (120 to provide a space for the user to sit on. The seating unit (170) will be examined in more detail with reference to FIG. 8.

FIG. 8 is a diagram showing a seating unit according to an embodiment of the present invention.

Referring to FIG. 8, the seating unit (170) according to one embodiment of the present invention may include includes a first seating frame (171), a second seating frame (172), a footrest (173), a seating unit (174), a height adjuster (175), a knee support (176), and a support angle adjuster (177).

The first seating frame (171) stands up from the support frame (110) and may have a curved part.

The second seating frame (172) may connect one point of the first seating frame (171) and the support frame (110).

The footrest (173) is seated on the support frame (110) and may be placed on the lower side of the first seating frame (171).

The seating unit (174) is placed on the upper side of the footrest (172), is connected to the second seating frame (172), and may provide a space for the user to sit on. The seating unit (174) may be made of a material that allows the user to feel soft when sitting on.

The height adjuster (175) can be provided to either slide vertically along the second seating frame (172) or be fixed to the second seating frame (172), while mediating the second seating frame (172) and the seating unit (174). The user can exercise more comfortably by adjusting the height adjuster (175) to change the height of the seating unit (174) from the floor.

The knee support (176) may be mounted on the first seating frame (171), placed higher than the seating unit (174), and placed above the knees of the user seated on the seating unit (174). The knee support (176) may be provided with a pair of knee support strips (not shown) to secure both thighs or knees of the user.

The support angle adjuster (177) may adjust the angle of the knee support (176) with respect to the first seating frame (171). The first angle adjuster (162), the second angle adjuster (163), and the support angle adjuster (177) may be provided with a plurality of angle adjusting holes (not shown) in a circular arc shape, one of which has an angle fixing pin, and thus by inserting (not shown), the user may adjust it to the desired angle. By providing the support angle adjuster (177), it is possible to respond to the body sizes of various users using the high-low machine (100).

Referring again to FIGS. 1 and 2, the mounting part (180) may be provided to protrude at a predetermined angle at one point of the support frame (110) and to define a lowering limit of the weight part (130).

Hereinafter, referring again to FIG. 9, the operation of the hi-low machine (100) of the present invention will be described.

FIG. 9 is a diagram showing the operation of a high-low machine according to an embodiment of the present invention.

Referring to FIG. 9, (a) shows a state before the user lowers the grip part (160), and (b) shows a state before the user lowers the grip part (160).

First, the user can fix a weight plate of desired weight to the weight part (30). Additionally, the user can adjust and fix the handle (161) to a desired angle using the first angle adjuster (162) and the second angle adjuster (163). Next, the user can sit on the seating unit (170) with his/her back to the main body frame (120) and adjust the height of the seating unit (174) according to the user's body size. Next, the user's legs can be fixed by adjusting the angle of the knee support (176) using the support angle adjuster (177). Users can exercise by lifting the weight plate of the weight part (130) by lowering the grip part (160) so that one end of the rotating part (140) moves from the raised position (see FIG. 9 (*a*)) to the lowered position (see FIG. 9 (*b*)) by gripping the handle (161) with one or two hands. Of course, the above-described movement may be implemented while looking at the main body frame (120). In this configuration, when the user lowers the grip part (160) while gripping it, the rotating part (140) connected to the grip part (160) rotates, and as the rotating part (140) rotates, the weight part (130) connected to the connecting part (150) is lifted. If the user wants to change the weight during exercise, he/she can change the weight by adjusting the length of the connecting part (150).

As we have seen above, according to an embodiment of the present invention, this invention provides the benefit of allowing the user to exercise intensely by adjusting the handle angle according to the user's needs to various angles and selecting the grip by providing a first angle adjuster and a second angle adjuster based on the two axes orthogonal to the grip section.

In addition, the high-low machine according to one embodiment of the present invention is capable of performing exercise by selecting one arm motion or both arm motion, so that customized motion can be performed according to the purpose of exercise, and the height of the seating unit, the angle of the knee support, etc. can be adjusted, so it provides the benefit of responding to the body sizes of various users.

As described above, although one embodiment of the present invention has been described with limited examples and drawings, one embodiment of the present invention is not limited to the above-described embodiment, which is based on common knowledge in the field to which the present invention pertains, and those skilled in the art to which the present invention pertains can make various modifications and variations from this description. Therefore, we believe that an embodiment of the present invention should be understood only by the scope of the claims set forth below, and that all equal or equivalent modifications thereof fall within the scope of the spirit of the present invention.

DESCRIPTION OF THE SYMBOLS

100: High-low machine
110: Support frame
120: Main body frame
130: Weight part
140: Rotating part
150: Connecting part
160: Grip part
170: Seating unit
180: Mounting part

The invention claimed is:

1. A high-low machine comprising:
a support frame (110) mounted on a floor;
a main body frame (120) connected to the support frame (110) to form a support structure;
a weight part (130) mounted to be able to rotate at one point on the main body frame (120) and on which a weight plate (131) is mounted;
a rotating part (140) rotatably mounted at another point of the main body frame (120);
a connecting part (150) provided to connect the weight part (130) and the rotating part (140) to transmit a load of the weight plate (131) to the rotating part (140) and to enable length adjustment between the weight part (130) and the rotating part (140); and
a grip part (160) connected to a free end of the rotating part (140) and providing a space for a user to grip; and
wherein the grip part includes:
a pair of handles (161) provided for the user to grip;
a pair of first angle adjusters (162) respectively provided at one end of each of the pair of handles (161) and configured to respectively adjust an angle of the pair of handles (161) with respect to a first axis; and
a pair of second angle adjusters (163) respectively provided to connect another end of each of the pair of first angle adjusters (162) to the free end of the rotating part (140), and to respectively adjust the angle of the pair of handles (161) based on a second axis orthogonal to the first axis; and
wherein when the grip part is lowered due to an external force applied by the user, the lowering of the grip part occurs in an arc motion path, and when the external force applied by the user is released, the grip part returns upward along the arc motion path via the load of the weight plate (131).

2. The high-low machine of claim 1, wherein the main body frame (120) includes:
a standing frame (121) extending upward from the support frame (110);
a pair of parallel frames (122) arranged in parallel with the standing frame (121);
a pair of inclined frames (123) respectively extending from upper ends of each of the pair of parallel frames (122) and respectively having upper ends connected to the standing frame (121); and
a connecting frame (124) horizontally connected between the pair of parallel frames (122).

3. The high-low machine of claim 2, wherein the rotating part (140) includes:
a first rotating frame (141) that has two curved parts and is provided as a 'U' shaped bar with two open ends, a first open end of the two open ends being the free end of the rotating part (140);
a bar-shaped second rotation frame (142) having two ends, a first end of the two ends of the bar-shaped second rotation frame (142) being coupled to a first point of the first rotation frame (141) located between the two open ends of the rotating part (140), the bar-shaped second rotation frame (142) having one curved part and one bent part;
a reinforcing frame (143) having two opposed ends, a first end of the two opposed ends being coupled to a second point of the first rotating frame (141) adjacent to a second open end of the two open ends of the first rotating frame (141) and spaced apart from the first point of the first rotation frame (141), and a second end of the two opposed ends being coupled to a first point of the second rotating frame (142) located between the two ends of the bar-shaped second rotation frame (142); and a weight (144) provided at a second end of the two ends of the bar-shaped second rotating frame (142) to balance a weight of the grip part (160).

4. The high-low machine of claim 3, wherein the first rotating frame (141) includes:

the grip part (160) coupled to the first open end of the two open ends of the first rotating frame (141);

the second open end of the two open ends of the first rotating frame (141) is link coupled to an upper end of the standing frame (121) so as to be rotatable; and an upper end of the connecting part (150) is linked to a second point of the second rotating frame (142) located between the two ends of the bar-shaped second rotation frame (142) and spaced apart from the first point of the second rotating frame (142).

5. The high-low machine of claim 4, further comprising a seating unit (170) including:

a first seating frame (171) extending upward from the support frame (110) and spaced apart from the standing frame (121), the first seating frame (171) having a curved part;

a second seating frame (172) connecting a first point of the first seating frame (171) and the support frame (110);

a footrest (173) that is seated on the support frame (110) and disposed on a lower side of the first seating frame (171);

a seat part (174) disposed on an upper side of the footrest (172), connected to the second seating frame (172), and providing a space for the user to sit;

a height adjuster (175) that slides in a height direction along the second seating frame (172) or is fixed to the second seating frame (172) while mediating between the second seating frame (172) and the seat part (174);

a knee support unit (176) mounted on the first seating frame (171), placed higher than the seat part (174), and is configured to be disposed above knees of the user when the user is seated on the seat part (174); and a support angle adjuster (177) that adjusts the angle of the knee support unit (176) with respect to the first seating frame (171).

* * * * *